United States Patent [19]

Barnes

[11] Patent Number: 5,058,403

[45] Date of Patent: Oct. 22, 1991

[54] SPOT AND COLLAR SCRUBBER

[76] Inventor: Albert T. Barnes, P.O. Box 5860 Rte. #5, Pottsville, Pa. 17901

[21] Appl. No.: 554,562

[22] Filed: Aug. 30, 1990

[51] Int. Cl.[5] ..... D06F 3/02

[52] U.S. Cl. ..... 68/229; 68/14

[58] Field of Search ..... 68/14, 214, 220, 223–231, 68/240; 248/27.5

[56] References Cited

U.S. PATENT DOCUMENTS

| | | | |
|---|---|---|---|
| 1,287,948 | 12/1918 | Frank | 248/27.5 |
| 1,966,512 | 7/1934 | Misner | 68/223 |
| 2,312,220 | 2/1943 | Snyder | 68/223 |
| 2,504,819 | 4/1950 | Flores | 68/229 X |

*Primary Examiner*—Philip R. Coe

*Attorney, Agent, or Firm*—Leonard Michael Quittner

[57] ABSTRACT

A washboard attachment for pre-laundering a garment is adapted for use with a top loading automatic laundry machine with an upwardly directed rotor and a basin. The attachment has means which fit over the rotor and a ribbed portion which spans the basin to support legs which stand on the basin's rim. The support legs are of a length so as to cause the washboard attachment to be downwardly directed toward the basin. The attachment has curved sides to contain incidental washwater and direct it to the basin.

2 Claims, 1 Drawing Sheet

SPOT AND COLLAR SCRUBBER

CROSS-REFERENCES

There are no cross-references to, nor are there any, related applications.

FEDERALLY-SPONSORED RIGHTS

The invention herein was made without any Federal sponsorship or contribution.

BACKGROUND OF THE INVENTION

1. The Field of the Invention

The field of the invention relates to an improved washboard attachment for an automatic clothes washer.

2. Description of the Prior Art

The prior art is best demonstrated by U.S. Pat. No. 1,966,512 (January, 1933 to Misner) and U.S. Pat. No. 2,312,220 (January, 1942 to Snyder). Misner teaches a washboard with resilient curvilinear leg supports which have suction cup feet to fit over the edge of a sink and legs opposite to support a washboard plate appended to the legs angularly on the bottom of the sink. Snyder teaches suction cup means designed to be resilient thereby offsetting the tendency of a washboard to slip during hand rubbing. U.S. Pat. No. 1,287,948 (December, 1918 to Frank) teaches a means for moving a washboard attached to a holding device for a washboard which stands in a tub.

None of the foregoing is adaptable to the unique problems created by the design of present day automatic clothes washing machines of the lidded, top loading type with an upwardly directed rotor set in a deep basin. For efficiency the basin space is largely inaccessable so as to maximize the effect of the rotor's action. Prelaundering of garments, for example with collars and cuffs, essentially must be carried out in a place remote from the machine or on the lid when it is open. The lid is generally unadaptable to the installation of a washboard or for the holding of one. None of the exemplars of the prior art known to your inventor solves or teaches a way to allow prelaundering in a manner so as to contain incidental wash water and direct it into a deep basin of the type nor be nonobstructing to the machine.

SUMMARY OF THE INVENTION

Objects of the present invention to provide a washboard attachment to a top loading automatic washing machine such that prelaundering may be accomplished superiorly adjacent to the machine. A further object is to provide a means for capturing and directing incidental wash water from the attachment into the machine.

Accordingly, to accomplish the foregoing, the present invention is summarized as a generally oblong washboard attachment made of a rigid non-rusting material for pre-laundering a garment to be laundered in a top-loading automatic clothes washing machine with an upwardly directed rotor on an axle with a hub. The attachment is oblong with a curved portion to form a trough around its working or ribbed surface. The attachment has disposed on it non-working surface a sleeve which fits over the rotor of the washer thereby permitting it to span across the top of the washer to legs fitted to engage the rim of the washer when open, the legs of such a length as to cause the washboard attachment to be downwardly directed toward the basin in the machine.

Other objects, advantages and features of the present invention will be apparent to those skilled in the art from the following description taken in conjunction with the accompanying drawings.

DESCRIPTION OF THE DRAWINGS

The present invention may be better understood by reference to the drawings wherein 3 figures are shown on 1 sheet. The numbers shown on the drawings for the various parts of the invention are consistent throughout so that a number indicating a part in one drawing will indicate the same part in another drawing.

DESCRIPTION OF THE PREFERRED EMBODIMENT

Figure 1:
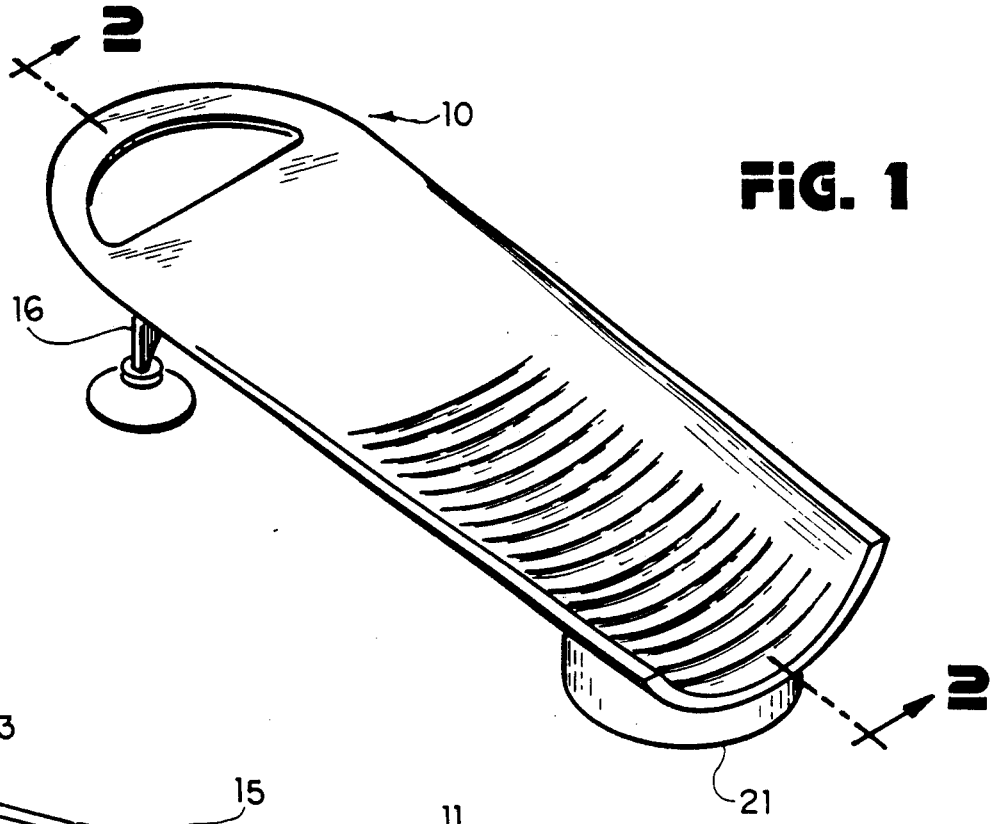
FIG. 1 shows a perspective view of the washboard of the invention.
Figure 2:
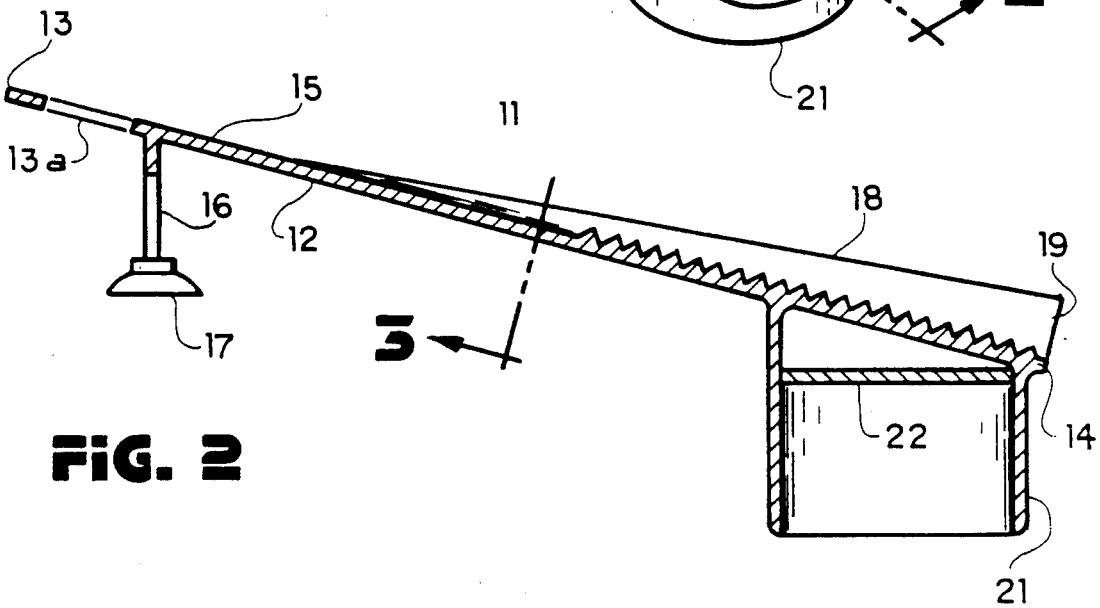
FIG. 2 is a longitudinal cross-sectional view of the washboard through line 2—2 in FIG. 1.
Figure 3:
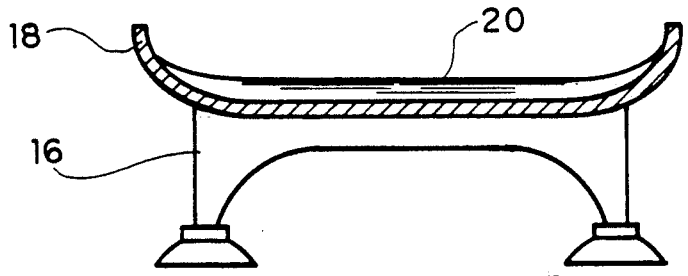
FIG. 3 is a transverse cross-sectional view through of the line 3—3 in FIG. 2.

The preferred embodiment is described as comprising a washboard attachment 10 made of a rigid, non-rusting material for laundering shirt collars and cuffs and the like the attachment being generally oblong and having a superior working surface 11 and an inferior surface 12, a first end 13 and a second discharge end 14 and having a flat portion 15 at the first end in which is formed a hand hold 13*a*. Situated below the hand hold and disposed on the inferior surface and extending therefrom at an angle is a support 16 of a defined length which has installed on its end distal to the inferior surface non-skid means 17 such as suction cups.

Adjacent the flat portion is a tapered curved portion 18 which terminates at the discharge end 14 whose curvature gradually increases from the flat portion to the discharge end so as to form a sluice 19. On the upper surface in the curved portion is formed a multiplicity of upwardly projecting transverse ribs 20 or corrugations formed in a manner well-known in the art.

Situated below the curved portion adjacent the discharge end is installed a cylindrical sleeve 21 projecting downward at an angle equal to the angle of the support and having contained therein stop means 22.

In operation, the washboard attachment 10 is installed in the opening of a top-loading automatic laundry machine with a deep basin having a horizontal rotor with an upwardly projecting axle. The sleeve fits over the axle hub, the attachment spans across the top of the basin and the support 16 rests on a rim of the basin such that the flat end 15 of the washboard attachment is substantially above the sluice 19.

Typically a garment such as a shirt with collars and cuffs needing special attention is disposed over the ribs 20, wetted with detergent or the like and scrubbed. The water is carried down to the sluice, out the discharge end 14 and into the washing machine basin after which the garment is placed in to the basin for further laundering.

Since many modifications, variations and changes in detail may be made to the presently described embodiment, it is intended that all matters in the foregoing description and accompanying drawings be interpreted as illustrative and not by way of limitation.

What is claimed is:

1. A washboard attachment made of a rigid, non-rusting material for use with a top loading automatic clothes washer with a hinged lid and an upwardly disposed rotor with a hub comprising:

(a) a working superior surface and an inferior surface, a flat portion beginning at a first end and adjacent to the flat portion a tapered curved portion gradually increasing in curvature to a second or discharge end to form a sluice, the flat portion having projecting from the inferior surface;

(b) support means at an acute angle to the flat portion and of a defined length and having (c) projecting from the inferior surface, adjacent the discharge end at the acute angle, a cylindrical sleeve for installation over the clothes washer's hub and having (d) a multiplicity of transverse ribs formed in the superior surface in the curved portion.

2. A washboard attachment as in claim 1 wherein the acute angle is sufficient to allow water on the superior surface to drain down the sluice into the washer.

* * * * *